US005839492A

United States Patent [19]

Young

[11] Patent Number: 5,839,492

[45] Date of Patent: Nov. 24, 1998

[54] WINDOW APPARATUS WITH BUILT IN SHADING DEVICE

[76] Inventor: Hai Tee Young, P.O. Box 6301, Rosemead, Calif. 91770

[21] Appl. No.: 839,688

[22] Filed: Apr. 14, 1997

[51] Int. Cl.[6] ..... E06B 3/32

[52] U.S. Cl. ..... 160/107; 160/172 R; 160/168.1 P

[58] Field of Search ..... 160/107, 168.1 R, 160/168.1 V, 176.1 R, 176.1 V, 172 R, 172 V, DIG. 17, 168.1 P, 176.1 P

[56] References Cited

U.S. PATENT DOCUMENTS

| | | | |
|---|---|---|---|
| 2,889,591 | 6/1959 | Pratt | 160/107 X |
| 3,153,819 | 10/1964 | Bond | 160/107 X |
| 3,291,193 | 12/1966 | Hagerty et al. | 160/107 |
| 3,326,267 | 6/1967 | Hauck | 160/107 |
| 3,795,267 | 3/1974 | Debs | 160/107 X |
| 4,096,903 | 6/1978 | Ringle | 160/107 X |
| 4,979,552 | 12/1990 | Zanden | 160/107 |

*Primary Examiner*—David M. Purol
*Attorney, Agent, or Firm*—David Raymond; Raymond Y. Chan

[57] ABSTRACT

A window apparatus includes a window framework, a shading device and a control device. The window framework comprises a first pair of parallel frames, a second pair of parallel frames which are perpendicularly mounted between the first pair of parallel frames defining a window framework, and a pair of transparent boards which are mounted on the window framework in parallel manner to define a receiving chamber therebetween. The shading device comprises a plurality of slats and a supporting device for mounting the slats parallelly inside the receiving chamber, i.e. between the pair of transparent boards. The control device which is incorporated with the supporting device for adjusting various displacing angles of the slats, gathering the slats toward a side of the window frame, and distributing the slats over the receiving chamber. Thereby, the window apparatus having a built in shading device installed within dual sheets of glass can provide a more efficient way of shading and the blocking of light and a more efficient way of insulating temperature and provide the resistance of sound entering and leaving the environment surroundings.

18 Claims, 18 Drawing Sheets

WINDOW APPARATUS WITH BUILT IN SHADING DEVICE

BACKGROUND OF THE PRESENT INVENTION

The present invention relates to a window apparatus, and more particularly to a window apparatus having a built in shading device.

Nowadays, shading devices are often applied to windows founded in all types of transportation units, such as automobiles and airplanes, and all types of construction structures, such as buildings and complexes. Such shading devices are used for purposes of blocking light, angulating for ambient light, blocking light for privacy issues, aesthetic looks, and more. However the shading devices that are available today are simple devices and items made of various types of curtains, roller shades, venetian blinds or other various types of blinds, shutters, and tints, which are not able to provide all of the listed above needs and purposes.

Shading devices are often used for housings, office buildings, and other complexes because of the need of privacy and the blocking of intense lighting that is caused by the directional facing of the building itself. Openings that are generally faced in any direction, other than north facing, are usually prone to intense light (in exception to other geographical circumstances) because of the directional self-rotation of the earth around the sun. The sun rises from the east and sets in the west, meaning that east, west, and south directional facings of building will be prone to intense light. Having intense lighting is very distracting and uncomfortable for working and living conditions. is because intense lighting is not only unpleasant, but also is annoying and distracting to the humans' visual sight and conceptions of sight, which means that shading device is a necessity to all living and working environments. Furthermore privacy is a very important need to people and that directional facings can not provide complete privacy.

Architecturally, it is possible to construct buildings and complexes to limit intense light by allowing more openings facing north and to provide more construction sun shading fixtures to window openings that receive intense light rather than desirable ambient light. This alternative is not always applied because first of all north facings are usually cold and second the usage of constructional sun shading devices are permanent fixtures which limit the option of those who desire extra lighting during cloudy days, and also the usage of architectural elements is only practical to apply during the constructional development of the building itself. Not only it is inconvenience to apply after the development stage, but also it is expensive to have structural changes. For the purpose of convenience and structural circumstances, commercial shading devices are applied to limit intense lighting or to reflect the intense light to become ambient light, and also to enable the blocking of light view to provide privacy.

Shading devices are also applied to transportation units, such as trains, airplanes, and automobiles, to provide privacy and the blocking of light and view. Once again transportation unit uses items such as tints and blinds which are only limited to their single function provided.

The current light shading devices used for windows available in the market are fixtures such as the roller shades, venetian blinds, indoor shutters, and curtains, as mentioned above. All of these interior devices are addition fixtures allowing more flexibility and control to shade and block intense light. Even though these devices are able to resolve the problem of intense lighting without the need of structural changes, but the usage of these fixtures has developed problems of inconvenience. Besides, the usage of blinds is impractical for automobiles. Referring to windows blinds, the major inconvenience is that blinds will be a hassle to clean and operate when the blinds get old. The manual operation of blinds, (esp. venetian blind) can be a hassle because during the pulling of the lift cord of the blinds, there are incidents where the cord will tangle and bend the lathes of the blinds, leaving the bottom rail suspending in a dislocate position. This is one of the reason why curtains are often used in home usage, while aesthetic needs are consider as well. Due to the aesthetic reasons, the availability of the selections is present.

Overall the conventional items used for light shading and blocking are similar and that they are designed to attach to the inner frame of windows. Having the device attached to the inside of the window frame develops problems such as damages during improper usage, the necessity of cleaning due to the collection of dust, and the nature deterioration of the item itself. Also the conventional items cannot provide an efficient way of blocking sound and light for people's need of privacy.

SUMMARY OF THE PRESENT INVENTION

The main object of the present invention is to provide a window apparatus having a built in shading device installed within dual sheets of glass, plastic, and etc., which can provide a more efficient way of shading and blocking of light.

Another object of the present invention is to provide a window apparatus with built in shading device which can provide a more efficient way of insulating temperature in addition to the sun light blocking by blinds. Furthermore, the present invention is also efficient to provide the resistance of sound entering and leaving the environment surroundings.

Another object of the present invention is to provide a window apparatus with built in shading device, in which the shading device is isolated from the surroundings and provides an easy way of cleaning and a better appearances for aesthetic purposes.

Another object of the present invention is to provide a window apparatus with built in shading device which enables electrically operation.

Another object of the present invention is to provide a window apparatus with built in shading device, wherein a shading device is installed between an inside and an outside window and that the dual windows is able to simultaneously open for ventilation by merely operating the inside window.

Accordingly, a window apparatus of the present invention comprises a window framework, a shading device and a control device.

The window framework comprises a first pair of parallel frames, a second pair of parallel frames which are perpendicularly mounted between the first pair of parallel frames to define a window framework, and a pair of transparent boards which are mounted on the framework in parallel manner to define a receiving chamber therebetween.

The shading device comprises a plurality of slats and a supporting device for mounting the slats parallelly inside the receiving chamber, i.e. between the pair of transparent boards.

The control device which is incorporated with the supporting device for adjusting the displacing angle of the slats, gathering the slats toward a side of the window frame and distributing the slats over the receiving chamber.

DETAIL DESCRIPTION OF THE PREFERRED EMBODIMENTS

Figure 1:
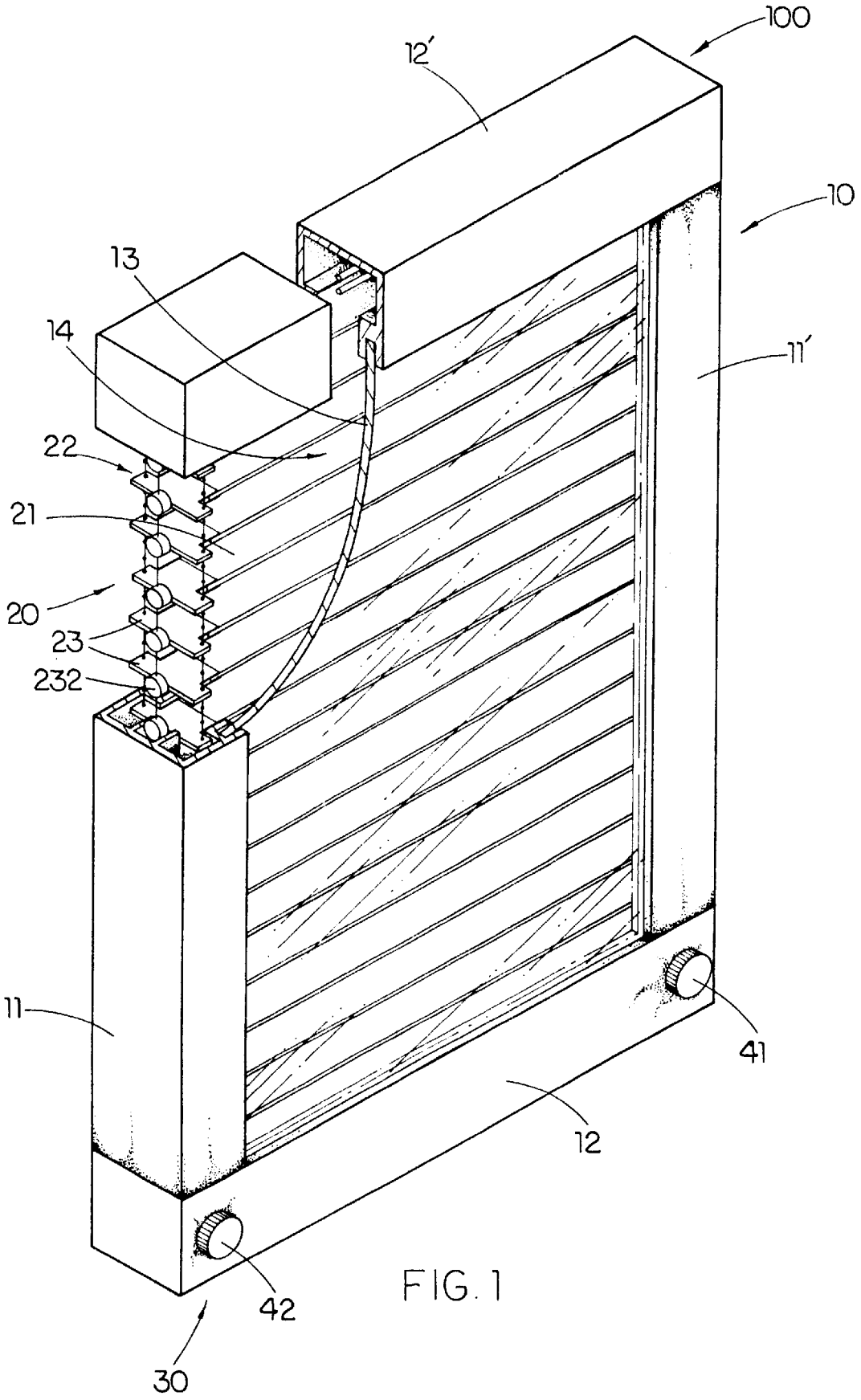
FIG. 1 is a partial sectional perspective view of a first preferred embodiment of the present invention.

Referring to FIGS. 1 to 4, a window apparatus with built in shading device is illustrated. The window apparatus comprises a window framework 100, a shading device 20 and a control device 30. The window framework 100 comprises a first pair of parallel frames 11, 11', a second pair of parallel frames 12, 12' which are perpendicularly mounted between the first pair of parallel frames 11, 11' to define the window framework 100, and a pair of transparent boards 13, 13' which are mounted on the window framework 100 in parallel manner to define a receiving chamber 14 therebetween. The shading device 20 comprises a plurality of slats 21 and a supporting device 22 for mounting the slats 21 parallelly inside the receiving chamber 14, i.e. between the pair of transparent boards 13, 13'. The control device 30 which is incorporated with the supporting device 22 for various controlling purposes, such as adjusting the displacing angle of the slats 21, gathering the slats 21 toward a side of the window frame 100 and distributing the slats 21 over the receiving chamber 14.

Figure 2:
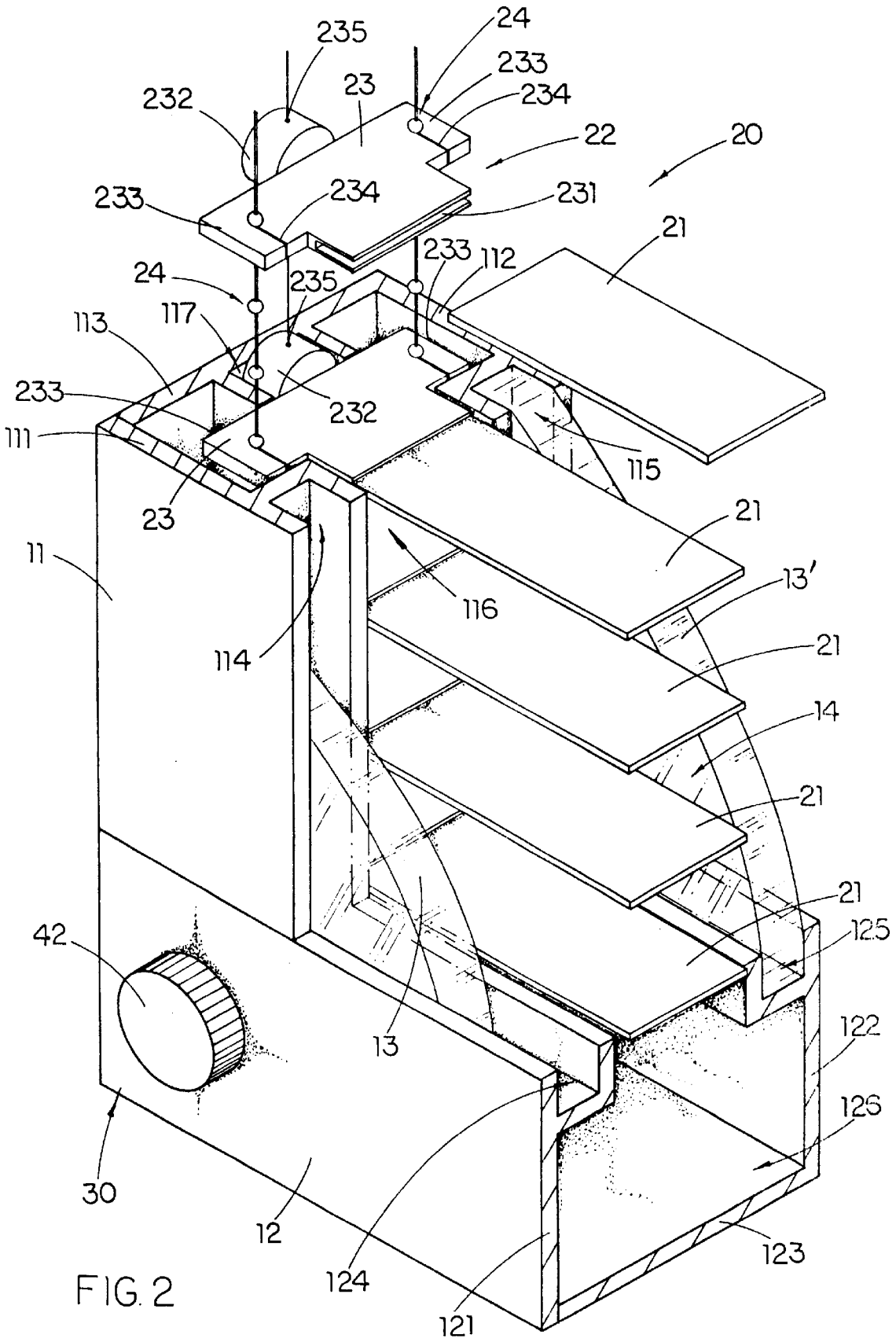
FIG. 2 is a sectional perspective view of a portion of the above first preferred embodiment of the present invention.

In accordance with the present first preferred embodiment, the first pair of frames 11, 11' are two symmetrical U-shape frames disposed in vertical and parallel manner. As shown in FIG. 2, each of the first frames 11, 11' has two parallel walls 111, 112 and an end wall 113 perpendicularly extended between two outer sides of the parallel walls 111, 112. Two first recesses 114, 115 are provided along two inner sides of the two parallel walls 111, 112 of each first frame 11, 11' respectively and that an operation chamber 116 is defined between the two first recesses 114, 115 and the end wall 113. A guiding rail 117 is provided along the end wall 113 in central portion. The second pair of frames 12, 12' are also two symmetrical U-shaped frames horizontally and parallelly disposed between the top ends and the bottom ends of the two first frames 11, 11' respectively. Each of the two second frames 12, 12' has two parallel walls 121, 122 and an end wall 123 perpendicularly extended between two outer sides of the parallel walls 121, 122. Two second recesses 124, 125 are provided along two inner sides of the two parallel walls 121, 122 of each second frame 12, 12' respectively and that a spacing chamber 126 is defined between the two second recesses 124, 125 and the end wall 123. The four first recesses 114, 115 of the two first frames 11, 11' and the four second recesses 124, 125 of the two second frames 12, 12' incorporate with each other to form a first and a second periphery receiving recess to receive the edges of the two transparent boards 13, 13' respectively for engaging the two transparent boards 13, 13' in parallel manner onto the window frame 100. The receiving chamber 14 is the space formed between the two transparent boards 13, 13', which are two pieces of glass according to the present invention. However, the two transparent boards 13, 13' can also be two pieces of transparent plastic or fiber glass.

As shown in FIG. 2, the slats 21 are made of light weight rigid material. The supporting device 22 comprises a plurality of supporters 23 connected to the corresponding ends of the slats 21 and a pair of supporting chains 24. Each pair of the supporting chains 24 is extended along the operation chambers 116 of the two vertical first frames 11, 11' respectively and the plurality of supporters 23, which are spaced with equal intervals in pair, are hanged in position by engaging with the pair of supporting chains 24 respectively so as to support the plurality of slats 21 in parallel manner within the receiving chamber 14.

As shown in FIG. 2, each supporter 23 has identical configuration that it has a receiving mouth 231 at one end for engaging with one end of the respective slat 21. Each supporter 23 further protruded a cylindrical guider 232 from a central portion of its other end and two side shoulders 233 at its two sides. The supporters 23 are disposed inside the two first frames 11, 11' respectively with their side shoulders 233 extended within the operation chambers 116 and their guiders 232 disposed in the guiding rails 117, so that each slat 21 is capable of rotating along the axis between the two guiders 232 of the two supporters 23 which are connected to the two ends of each slat 21. The up and down motion of each slat 21 is also able to be guided by the guiding rails 117 of the two first frames 11, 11'. Furthermore, each side shoulder has a slit 234 for firmly engaged to a predetermined position of the respective supporting chain 24 and each guider 232 has a through hole 235 parallel to the guiding rails 117.

Figure 3:
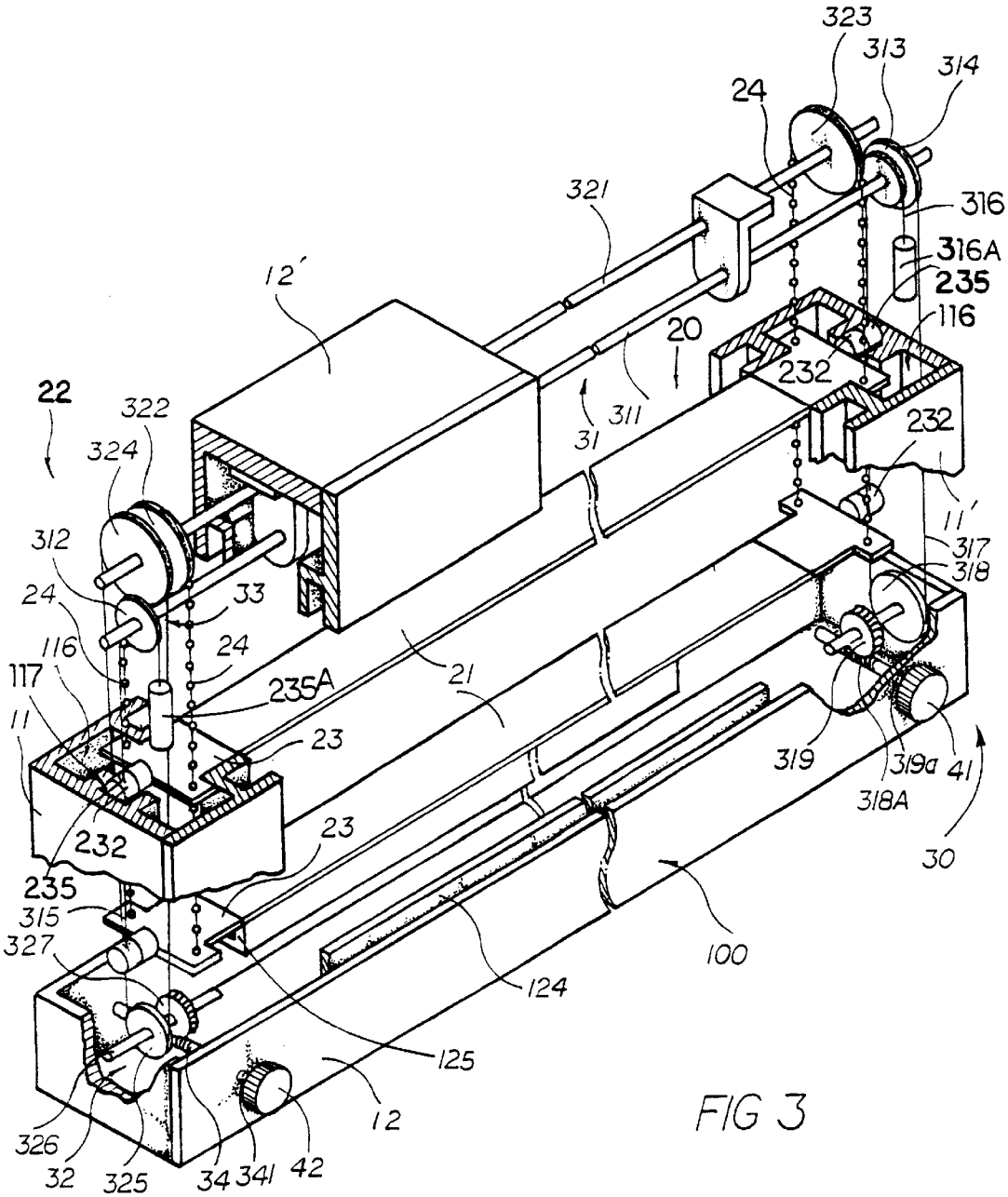
FIG. 3 is a sectional perspective view, illustrating a control device, of the above first preferred embodiment of the present invention.

Referring to FIG. 3, the control device 30 comprises a gathering mechanism 31 and a tilting mechanism 32 disposed inside the window frame 100. The gathering mechanism 31 comprises a driving rod 311 which is mounted along the top second frame 12' in rotatable manner and has two cord pulleys 312, 313 affixed to the two end portions of the driving rod 311. One end of the driving rod 311 further comprises a driven wheel 314 in close proximity to the cord pulleys 313.

As shown in FIG. 3, the gathering mechanism 31 further comprises a pair of cords 315, 316, an endless driving chain 317, a driving wheel 318, and a driving worm gear 319. One end of each cord 315, 316 is winded over the respective cord pulley 312, 313 to connect with a balance load 315A, 316A. The two balance loads 315A, 316A, which are disposed within the operation chambers 116 of the two first frames 11, 11', are preferably having a total weight equal to the total weight of all the slats 21 and the supporters 23. The other ends of the two cords 315, 316 are respectively extended downward through the through holes 235 of the supporters 23 and affixed to the lowermost pair of supporters 23, in which all the supporters 23 are disposed within the operation chambers 116 of the two first frames 11, 11'. Thus, the plurality of slats 21 can be hanged and supported inside the receiving chamber 14 as shown in FIG. 2.

Figure 6A:
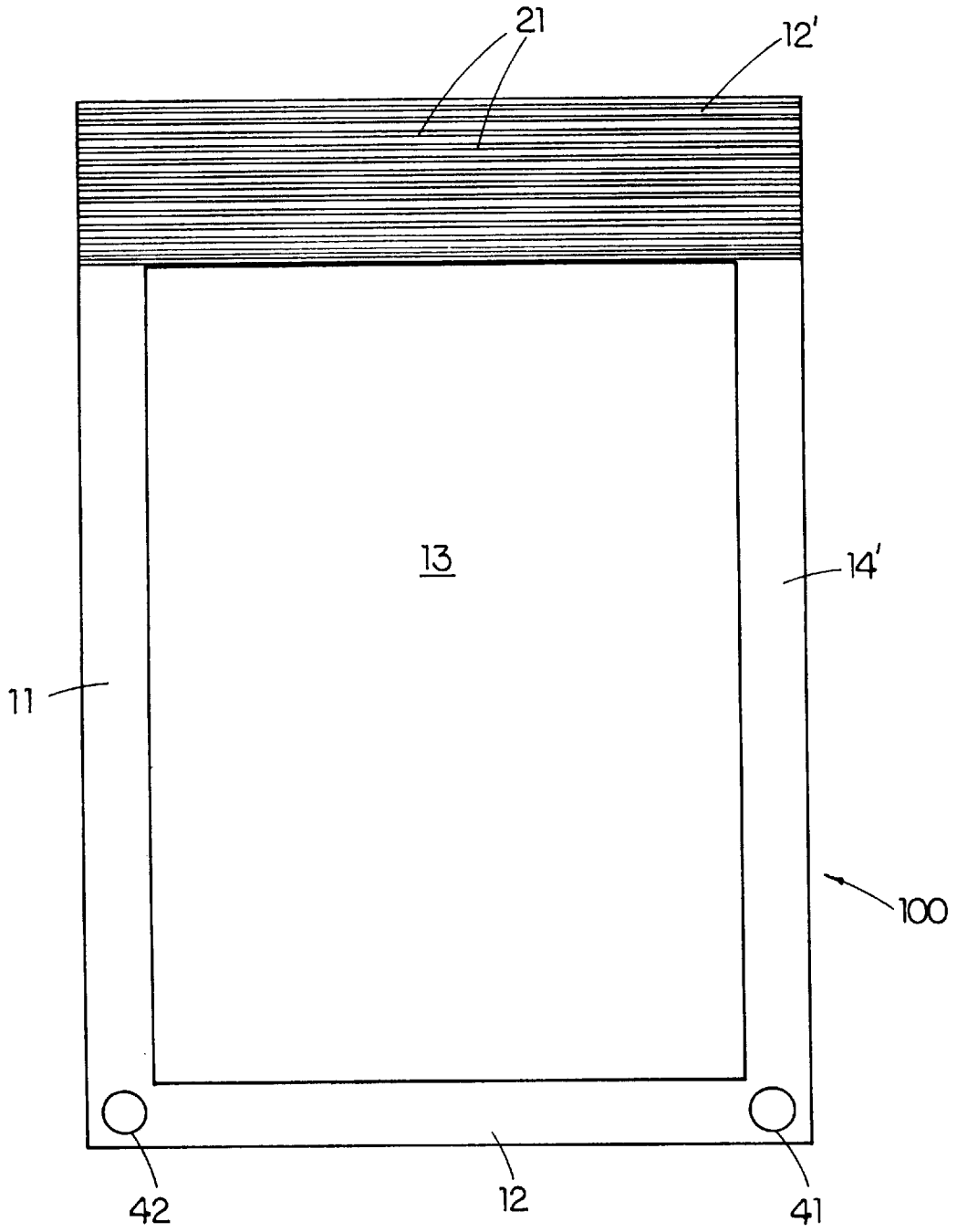
FIG. 6A is a sectional end view of the above first preferred embodiment of the present invention while the slats are gathering upward.

As shown in FIG. 3, a driving wheel 318 is mounted in the bottom second frame 12 in rotatable manner. The driving chain 317 is linked between the driven wheel 314 and the driving wheel 318 by engaging with the driven wheel 314 and the driving wheel 318. The driving worm gear 319, which is meshed with a driving wheel worm gear 318*a* coaxially mounted to the driving wheel 318, is transversely disposed inside the bottom second frame 12 and has a shaft 319*a* extending outside the bottom second frame 12 to secure with a rotation button 41. Accordingly, to rotate the rotation button 41 will drive the driving worm gear 319 to rotate which will drive the driving wheel worm gear 318*a* and the driving wheel 318 to rotate also. By means of the driving chain 317, the driven wheel 314 will be driven to rotate so as to drive the driving rod 311 and the two cord pulleys 312, 313 to rotate simultaneously. Therefore, according to the first embodiment as shown in FIG. 3, to rotate the rotation button 41 will drive the two cord pulleys 312, 313 to rotate and drive the two balance loads 315A, 316A moving downwards. Thus the lowermost slat 21 is lifted horizontally upward by the two cords 315, 316. Gradually rotate the rotation button 41 can lift the plurality of slats 21 upward to gather underneath the top second frame 12', as shown in FIG. 6*a*.

As shown in FIG. 3, the tilting mechanism 32 according to the first embodiment comprises a tilt rod 321 which has two tilters 322, 323 mounted near its two end portions respectively and a first tilt wheel 324 mounted at one end of the tilt rod 321. An endless driving thread 33 is winded around the first tilt wheel 324 and a second tilt wheel 325 which is rotatably mounted on a supporting shaft 326. The supporting shaft 326 is rotatably mounted in the bottom second frame 12 and frther rotatably mounted a driving gear 327 thereon. An operating worm gear 34 transversely disposed inside the bottom second frame 12. An operating button 42 which is connected to a shaft 341 of the operating worm gear 34 is positioned outside the bottom second frame 12.

The top ends of the two supporting chains 24 are engagedly winded around the two tilters 322, 323 respectively, so that when the tilting rod 321 is rotated, the plurality of slats 21 within the receiving chamber 14 (as shown in FIG. 2) of the window framework 100 will be driven to tilt with a desired slant angle. Accordingly, to rotate the operating button 42 can adjust the slant angle of the plurality of slats 21 simultaneously.

Figure 4:
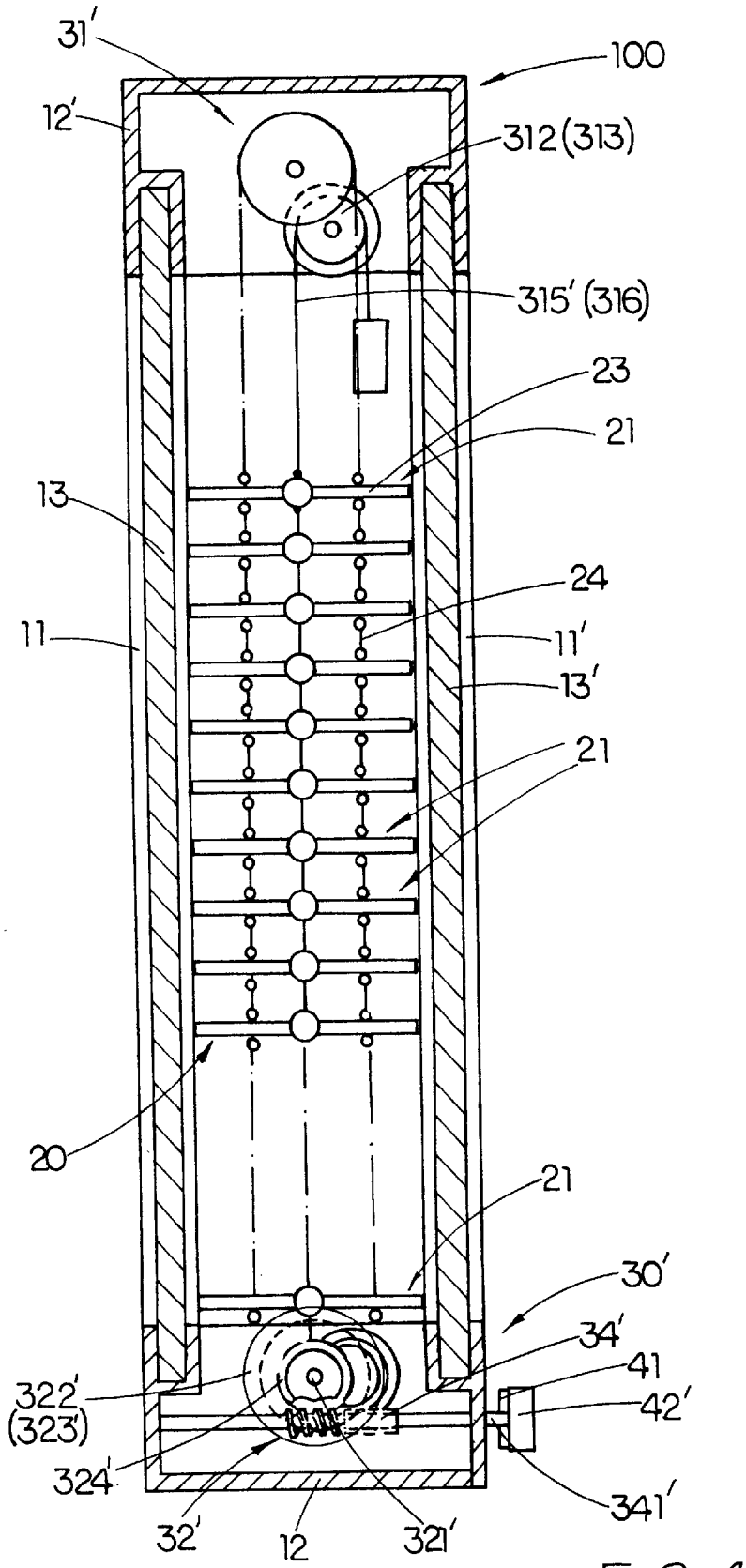
FIG. 4 is an end view of an alternative mode of the above first preferred embodiment according to the present invention.

Referring to FIG. 4, an alternative mode of the above embodiment is illustrated, in which the plurality of slats 21 are capable of gathering downwardly. Basically, the window framework 100 and the shading device 20 of this alternative mode are identical to the above first embodiment. However, the control device 30' of this alternative mode is specifically designed for capable of gathering the slats 21 downwardly. The control device 30' also comprises a gathering mechanism 31' and a tilting mechanism 32' disposed inside the window frame 100.

Figure 6B:
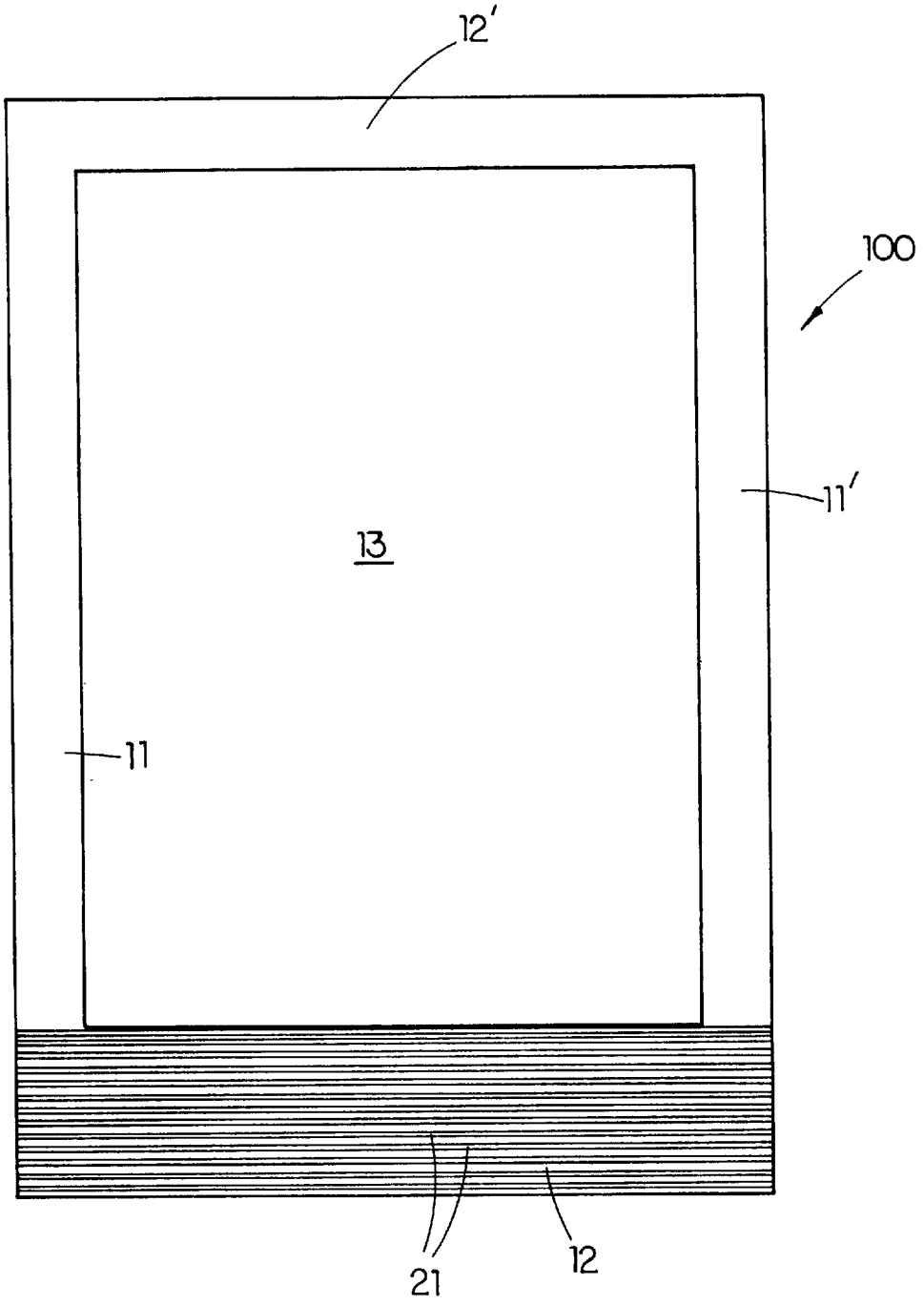
FIG. 6B is a sectional end view of the above first preferred embodiment of the present invention while the slats are gathering downward.
Figure 7A:
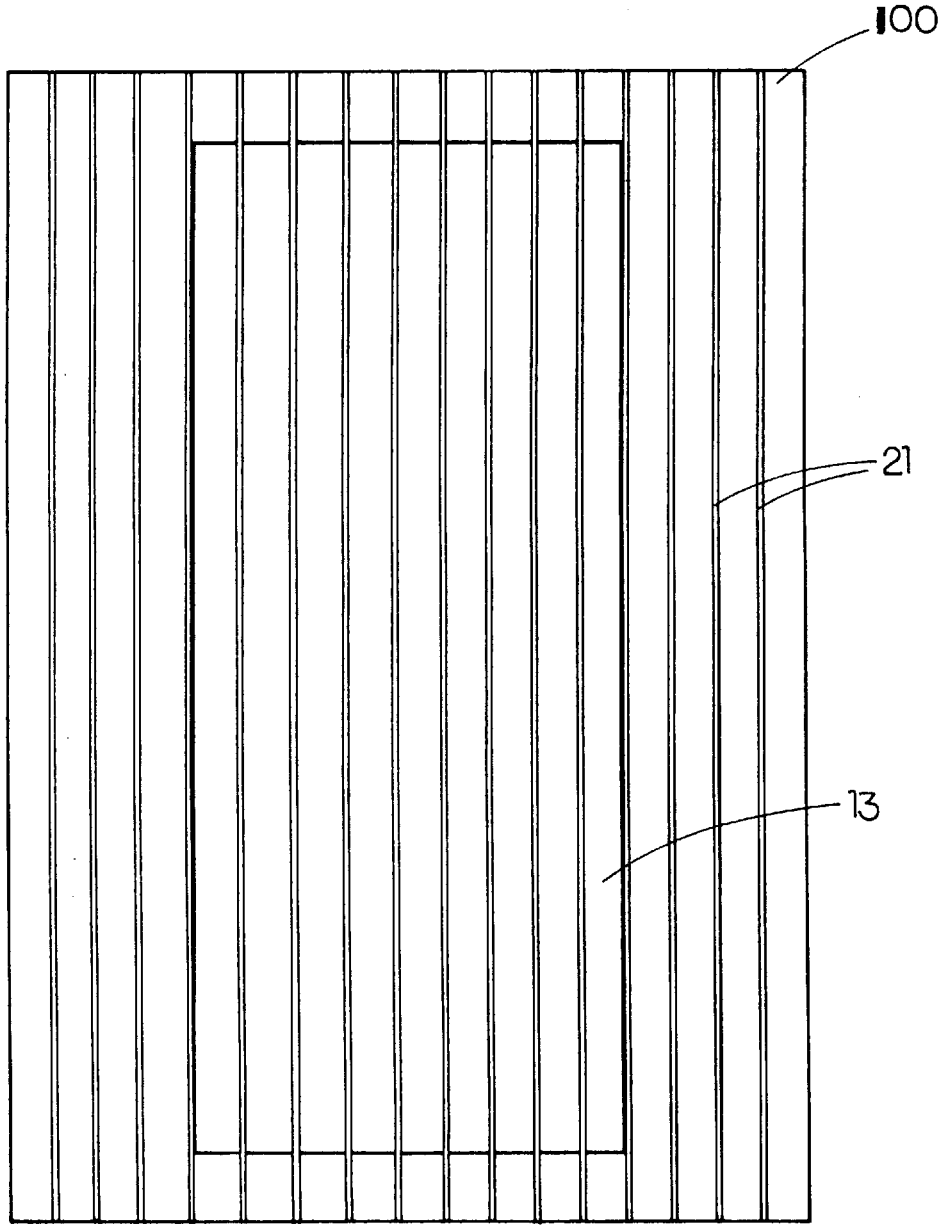
FIG. 7A is a front view of another alternative mode of the above first preferred embodiment of the present invention in which the slats are vertically displaced.
Figure 7B:
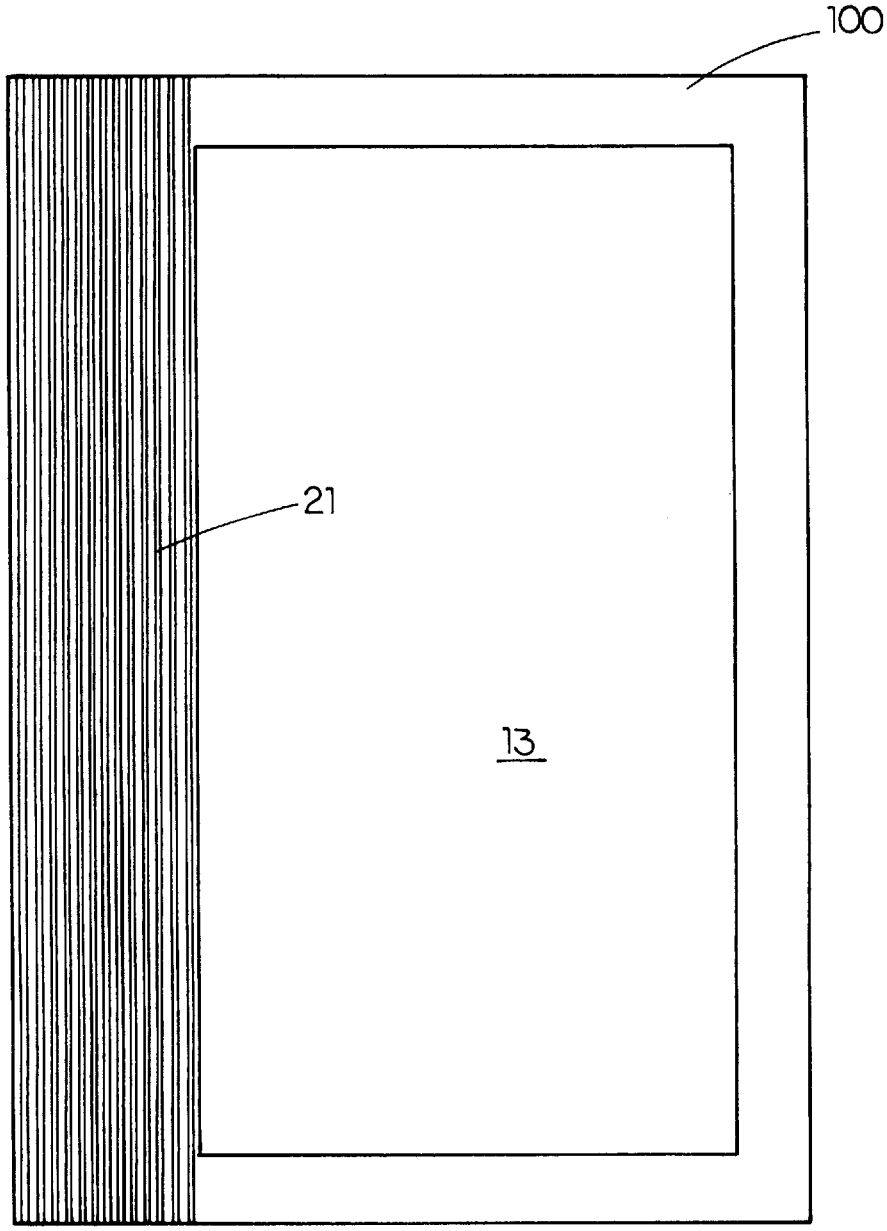
FIG. 7B is a front view of the above second alternative mode of the present invention in which the vertical slats are gathering toward a left side of the window frame.
Figure 7C:
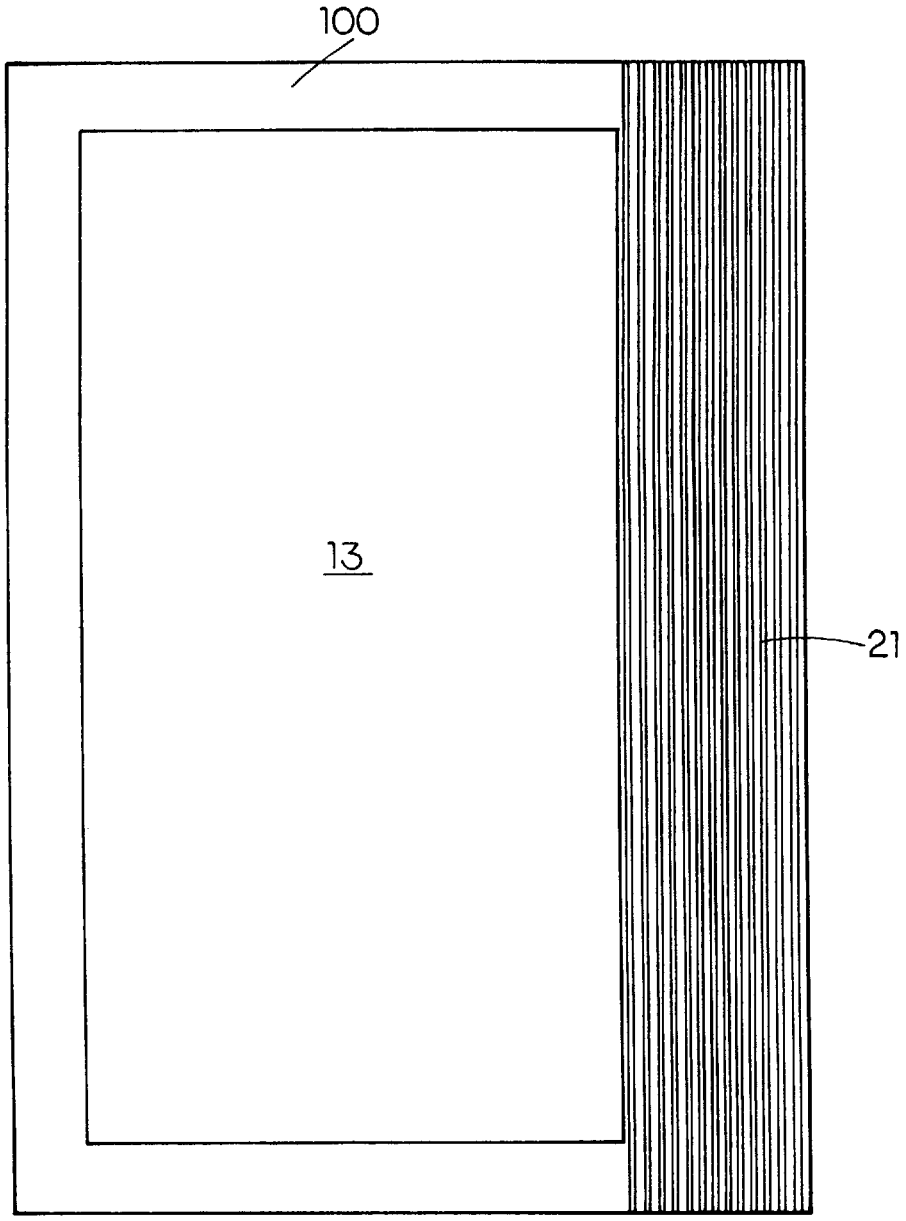
FIG. 7C is a front view of the second alternative mode of the present invention in which the vertical slats are gathering toward a right side of the window frame.
Figure 7D:
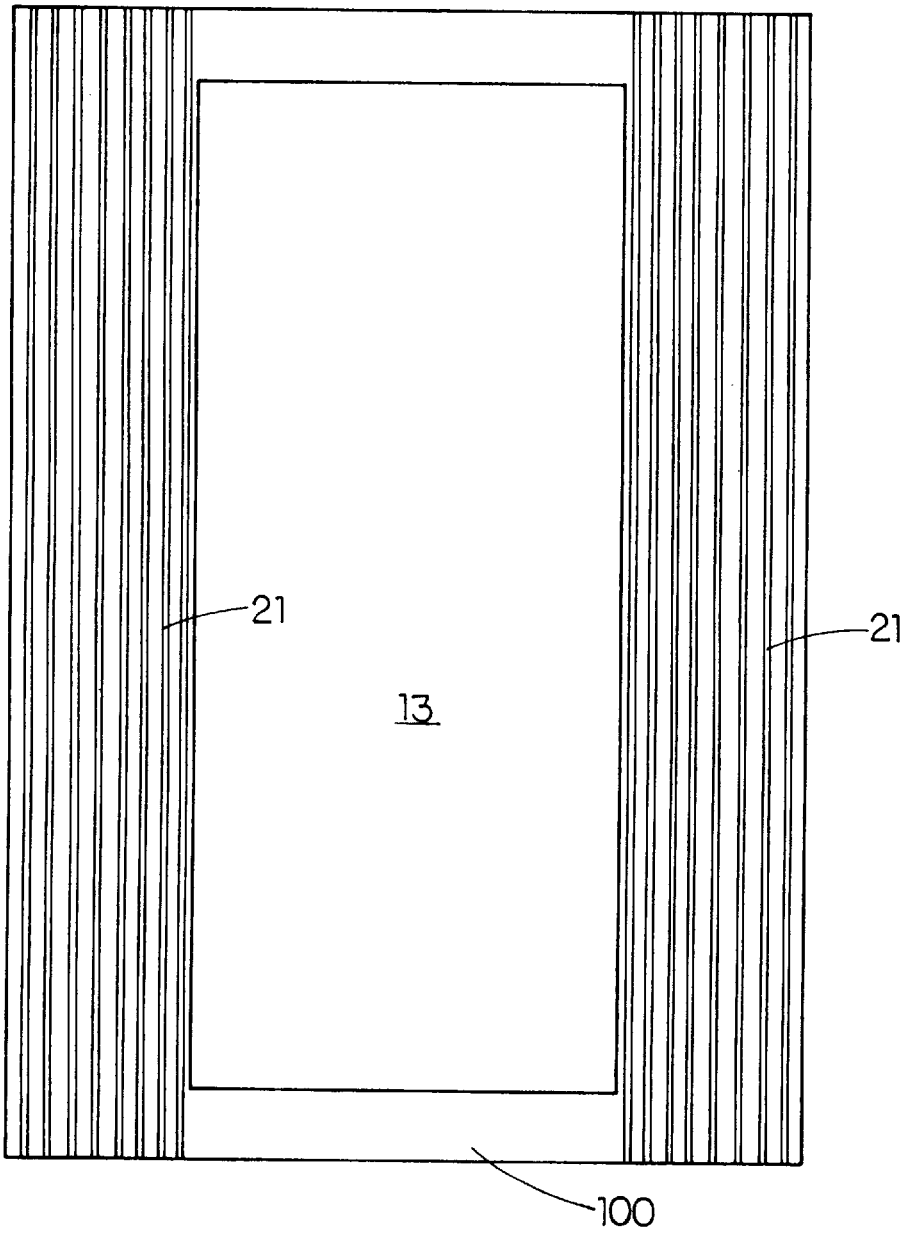
FIG. 7D is a front view of the second alternative mode of the present invention in which the vertical slats are gathering toward both the left and right sides of the window frame.

The gathering mechanism 31', as shown in FIG. 4, has similar configuration with the above first embodiment as shown in FIG. 3, wherein the two cords 315', 316' of the gathering mechanism 31' are further firmly secured with the uppermost slat 21. The tilting mechanism 32' comprises a tilt rod 321' disposed inside the bottom second frame 12. The tilt rod 321' further comprises two tilters 322', 323' mounted near its two end portions respectively and a tilt worm gear 324' mounted at one end of the tilt rod 321'. An operating worm gear 34' which is meshed with the tilt worm gear 324' is transversely disposed inside the bottom second frame 12. An operating button 42' is connected to a shaft 341' of the operating worm gear 34' which is extended outside the bottom second frame 12. The top ends of two supporting chains 24 are respectively affixed to the two supporters 23 connecting to the two ends of the uppermost slat 21 respectively and the bottom ends of the two supporting chains 24 are engaged with the two tilters 322', 323' respectively. So that when the tilting rod 321' is rotated, the plurality of slats 21 will be driven to tilt with a desired slant angle. Since the tilt worm gear 324' is meshed the operating worm gear 34', accordingly, to rotate the operating button 42' can adjust the slant angle of the plurality of slats 21' simultaneously. Moreover, to rotate the rotation button 41' of the gathering mechanism 31' will drive the two cord pulleys 312', 313' to rotate and thus the uppermost slat 21 is hanged horizontally downward. Gradually rotate the rotation button 41' can operate the plurality of slats 21 downward by means of gravity to gather above the bottom second frame 12, as shown in FIG. 6*b*. However, to rotate the rotation button 41' in opposite direction will drive the two cord pulleys 312', 313' to rotate in opposite direction and swing the two cords 315', 316' around the two cord pulleys 312', 313' and thus the uppermost slat 21 is lifted horizontally upward by the two cords 315', 316'. Gradually rotate the rotation button 41' can lift the plurality of slats 21 upward to hang over the receiving chamber 14.

Referring to FIGS. 7*a* to 7*d*, another alternative modes of the present invention is illustrated, in which the window apparatus with built in shading device as disclosed in the above embodiment (as shown in FIG. 3 or 4) is turned 90 degree to dispose in up right position so that the slats are parallelly and vertically mounted within the receiving chamber of the window frame.

Figure 5:
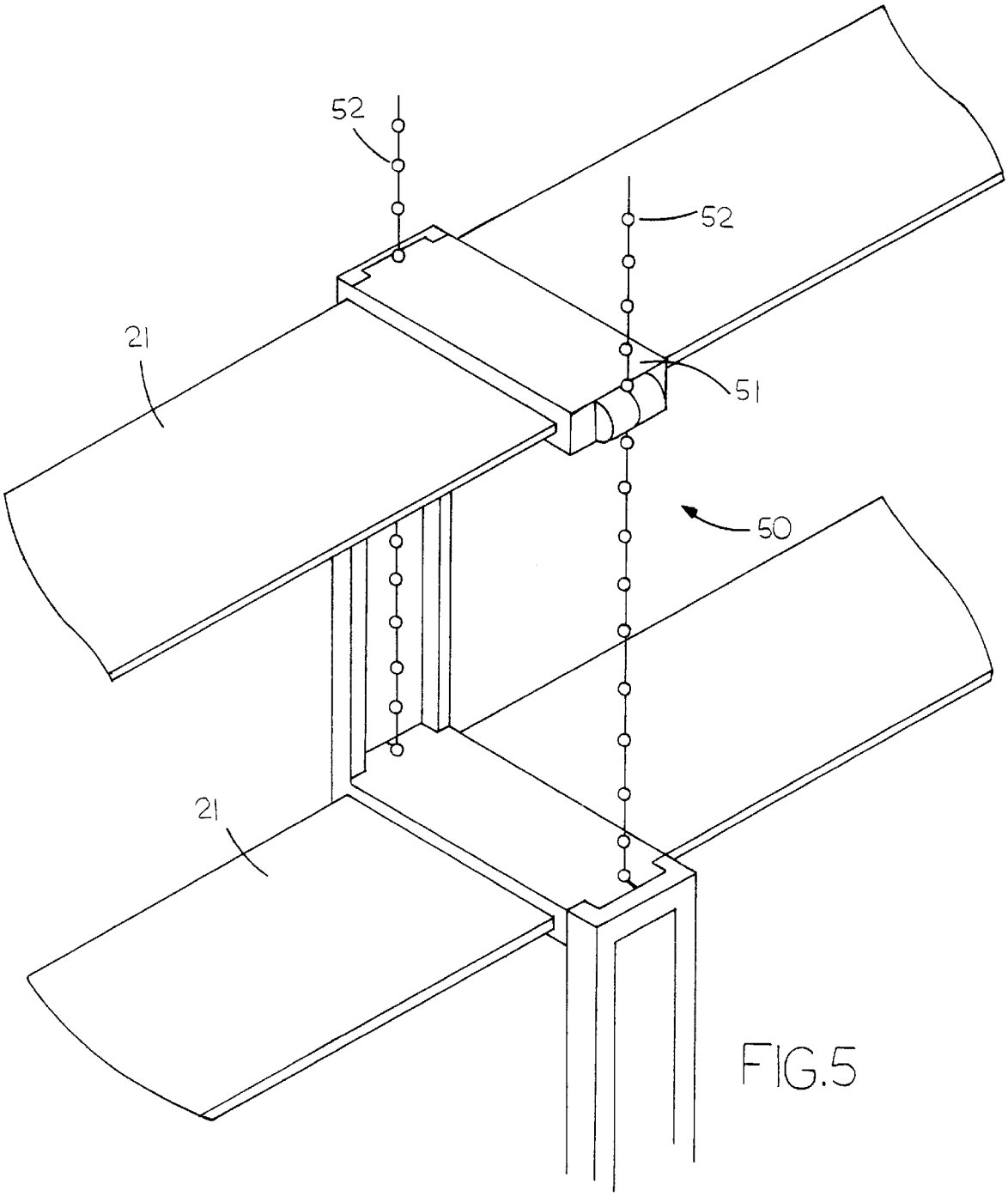
FIG. 5 is a perspective view of an auxiliary supporting device of the present invention.

When the window frame 100 has a wide width, the window apparatus can further comprises at least an auxiliary supporting device 50 disposed between and parallel to the pair of first frame 11, 11', as shown in FIG. 5. The auxiliary supporting device 50 includes a plurality of supporting seats 51 and a pair of supporting chains 52 attached to two sides of the supporting seats 51. The middle portion of each slat 21 is mounted on the corresponding supporting seats 51 respectively. The top ends of the two supporting chains 52 are fixed to the top second frame so as to hang and support the supporting seats 51 and thus an additional supporting force is applied to the middle portion of each of the long slats 21.

Figure 8:
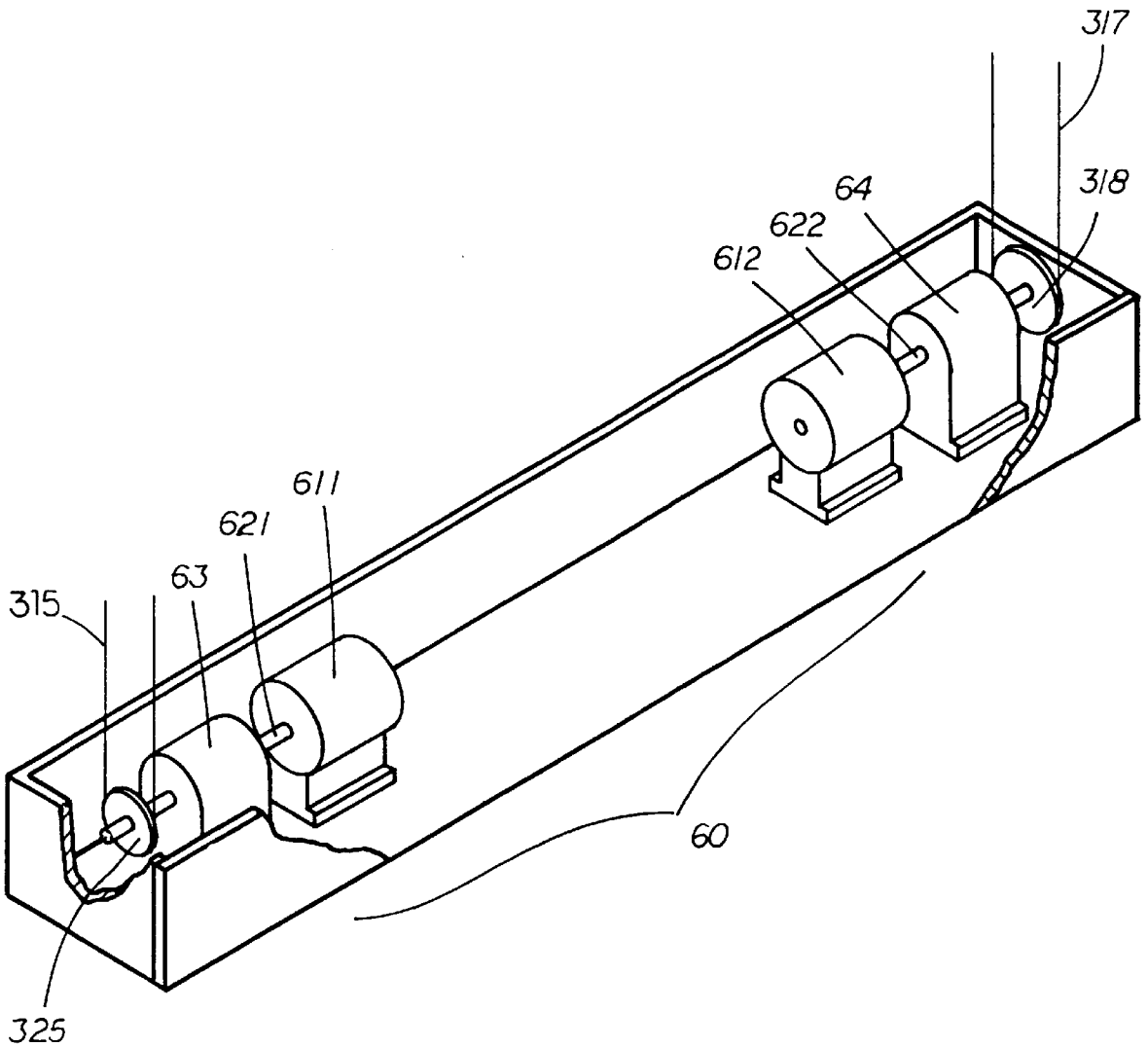
FIG. 8 is a perspective view of an electrical driving device which is applied to the present invention.

Referring to FIG. 8, an electrical driving device 60 which can be incorporated with the present invention is illustrated. The electrical driving device 60 comprises two rotary power sources 611, 612, such as motors, two driving shafts 621, 622 and two deceleration gear boxes 63, 64 for decelerating the rotating speed of the two driving shafts 621, 622 respectively. The two driving shafts 621, 622 are connected to the second tilt wheel 325 and the driving wheel 318 respectively. Accordingly, the shading device of the window apparatus can be operated electrically and automatically. Moreover, a plurality of window apparatus can be operated simultaneously by means of the electrical driving device 60. Additionally, well known remote control means may incorporate with the electrical driving device 60 to achieve remote function.

Figure 9:
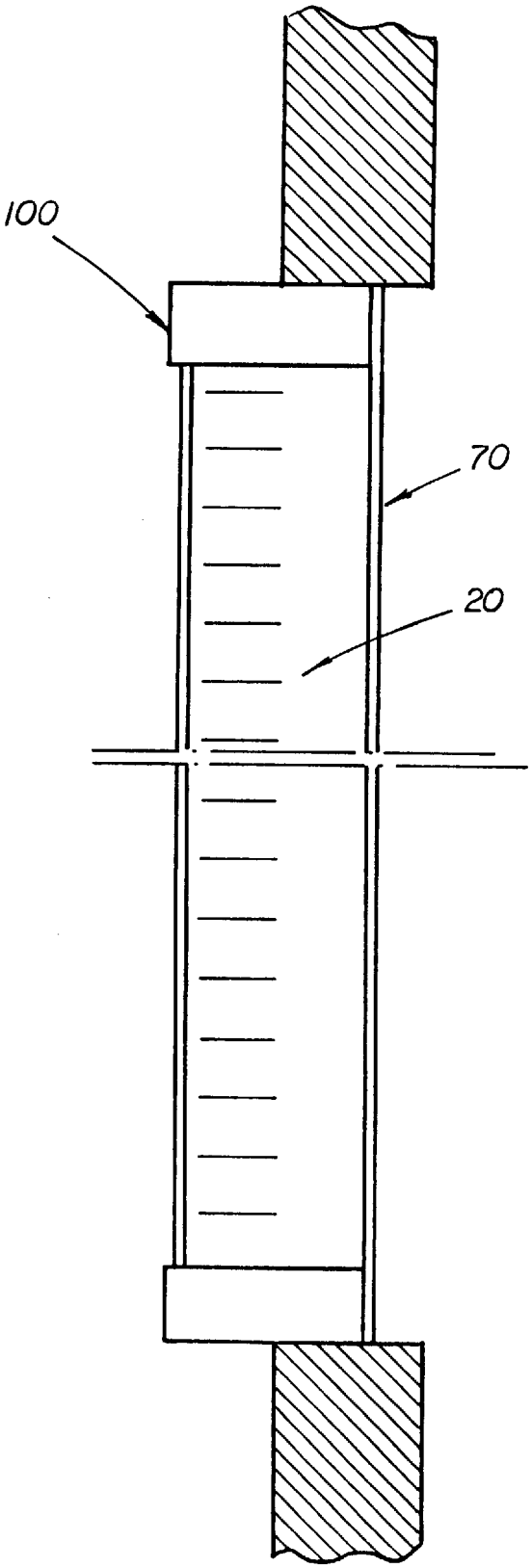
FIG. 9 is end view of a modification mode of the present invention.

Referring to FIG. 9, a modification mode of the present invention is illustrated, in which the window frame 100 of the window apparatus has only one piece of glass mounted at one side of the window frame. The window apparatus having just one single glass is thus able to be installed to a normal window 70 of a building or a transportation unit in usual manner.

Figure 10:
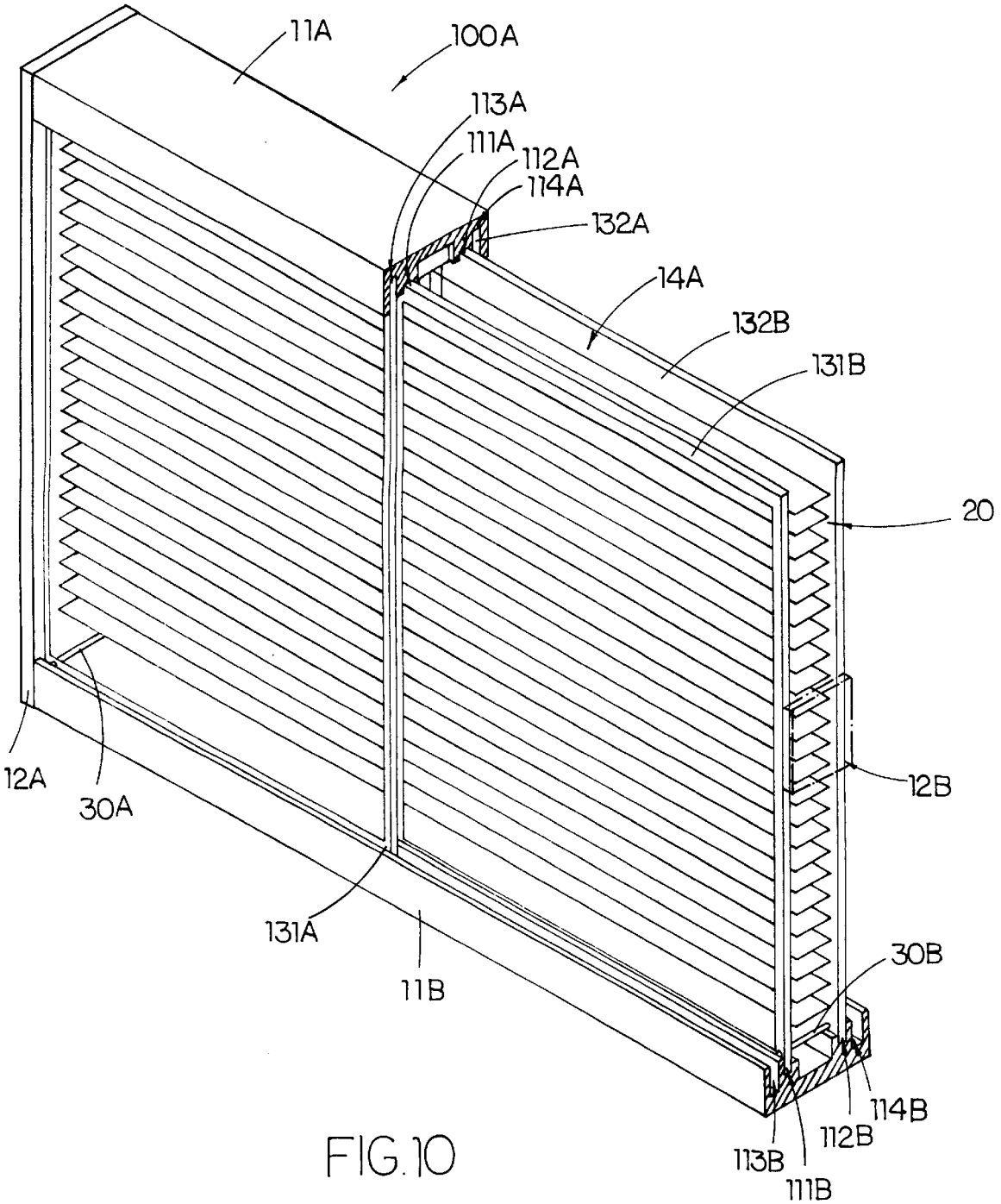
FIG. 10 is a partial sectional perspective view of a second preferred embodiment according to the present invention.

Referring to FIG. 10, a window apparatus with built in shading device according to a second preferred embodiment of the present invention is illustrated, which comprises a window framework 100*a* constructed by a top frame 11*a* and a bottom frame 11*b* which are disposed in parallel position and supported by two parallel side frames 12*a*, 12*b* connected between the two end sides of the top frame 11*a* and the bottom frame 11*b* respectively. Each of the top frame 11*a* and the bottom frame 11*b* has two inner sliding grooves 111*a*, 112*a*, 111*b*, 112*b* and two outer sliding grooves 113*a*, 113*b*, 113*b*, 114*b* for receiving two pairs of transparent boards 131*a*, 131*b*, 132*a*, 132*b* respectively. Therefore the four transparent boards 131*a*, 131*b*, 132*a*, 132*b* can be sliding from left to right or from right to left. A shading device 20, as disclosed in the above first embodiment or a conventional blind, is installed within a receiving chamber 14*a* defined between the top and bottom frames 11*a*, 11*b* and the two pairs of transparent boards 131*a*, 131*b* and 132*a*, 132*b*.

A first pin like connector 30*a* connects the outer pair of the transparent boards 131*a*, 132*a* together at their bottom corner positions near one of the parallel side frames 12*a*. A second pin like connector 30*b* connects the inner pair of the transparent boards 131*b*, 132*b* together at their bottom corner positions near the other parallel side frame 12*b*. Therefore, when the user slide the transparent board 131*a* or 131*b* to move from right to left or from left to right, the other transparent board 132*a* or 132*b* will be driven to move simultaneously. The aim of this second embodiment is to illustrate that the transparent boards of the window apparatus of the present invention are able to be constructed as sidable to open or close the window.

Figure 11:
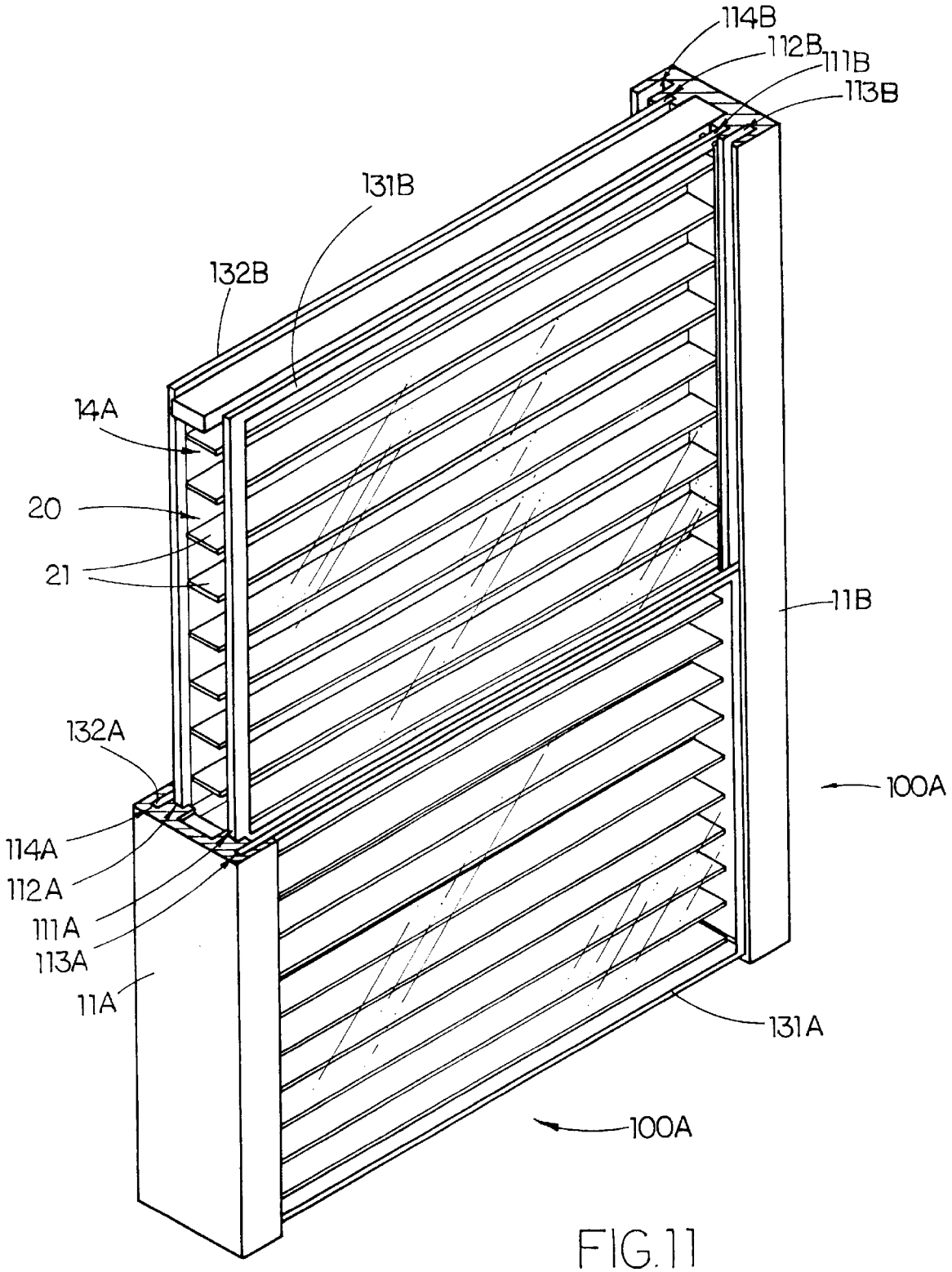
FIG. 11 is a partial sectional perspective view of an alternative mode of the above second preferred embodiment according to the present invention.
Figure 12A:
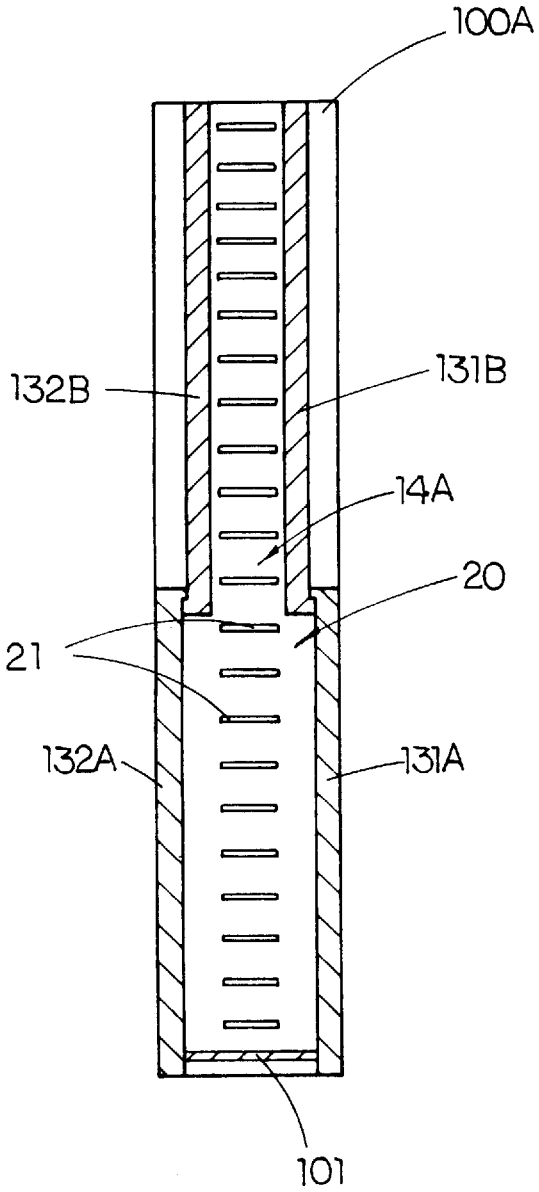
FIG. 12A is a sectional end view of the alternative mode of the above second preferred embodiment of the present invention.
Figure 12B:
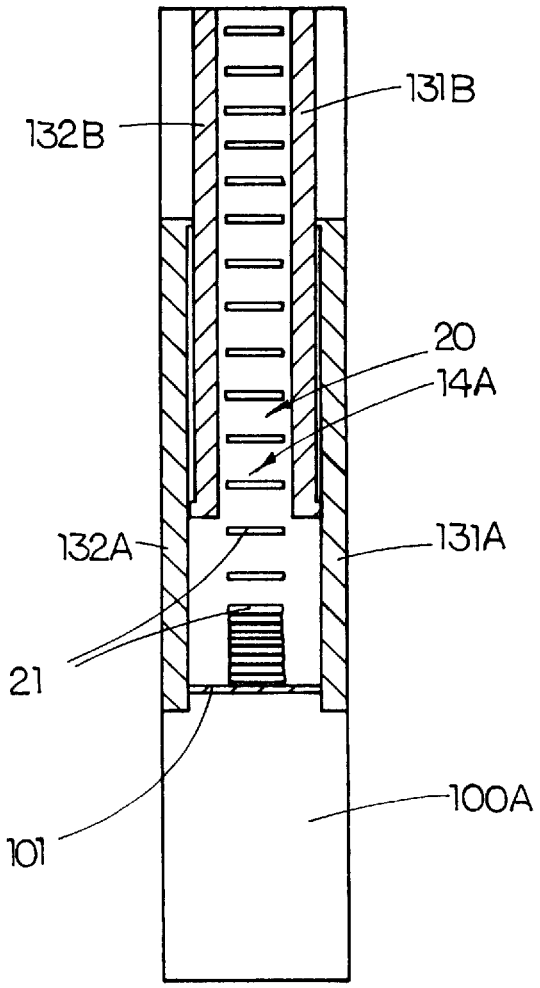
FIG. 12B is a sectional operating end view of the alternative mode of the above second preferred embodiment of the present invention.

Referring to FIGS. 11 and 12, an alternative mode of the above second preferred embodiment of the present invention is illustrated, which has a same configuration of the above second preferred embodiment. The only difference between this alternative mode with the above second embodiment is that the window framework 100 is turned 90 degree to an upright position, as shown in FIGS. 11 and 12A, and all the slats 21 of the shading device 20 are remained in transverse position within the receiving chamber 14*a*. Moreover, a bottom supporting frame 101 is connected between the bottom sides of the outer pair of the transparent boards 131*a*, 132*a*, so that when the outer pair of the transparent boards 131*a*, 132*a* are push upwards, the slats 21 will be carried upwards simultaneously, as shown in FIG. 12B. Such alternative mode is specially suitable to be installed in transportation tools such as bus, train and ship.

Figure 13:
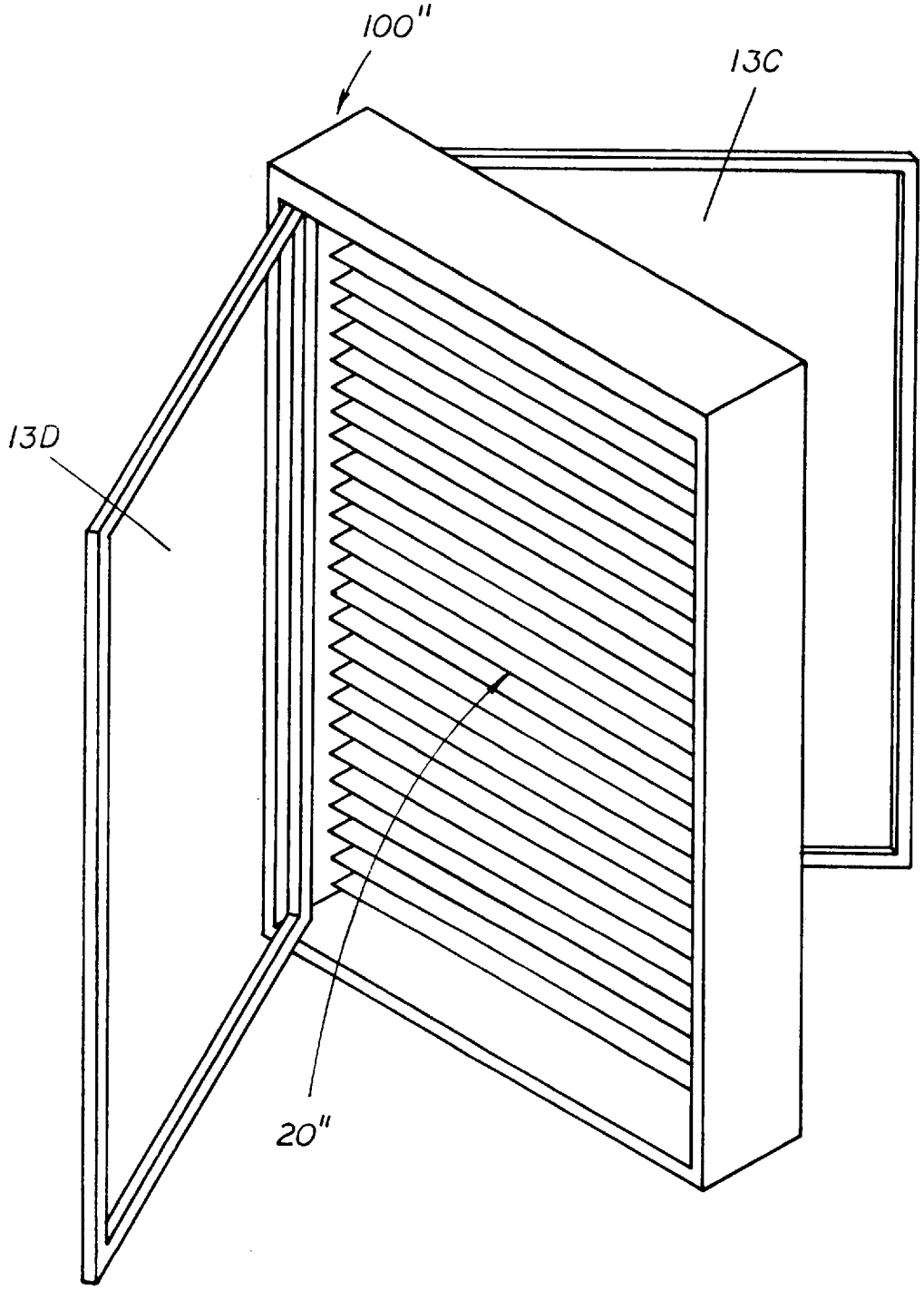
FIG. 13 is a perspective view of a third preferred embodiment according to the present invention.
Figure 14:
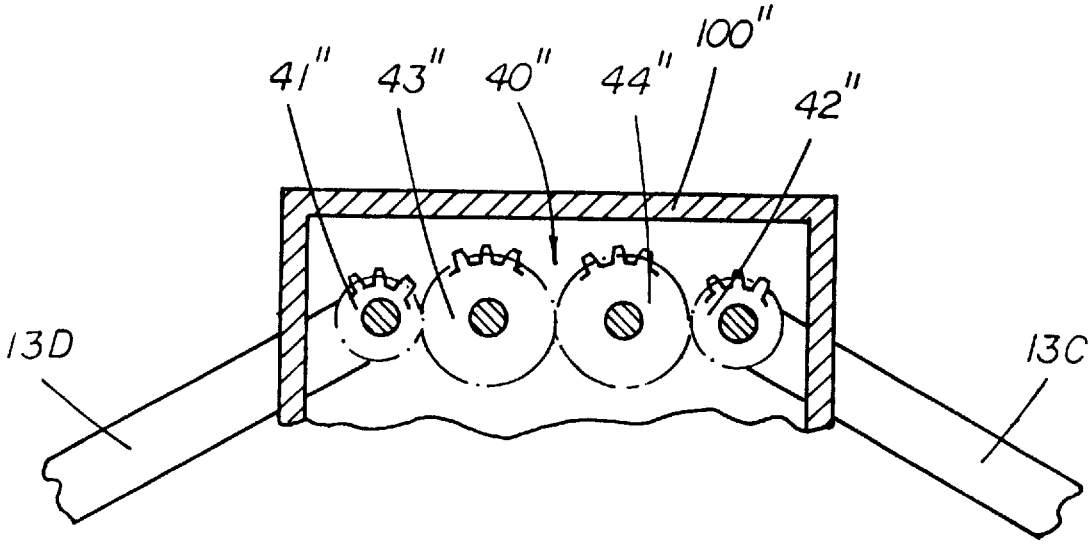
FIG. 14 is a sectional plan view of a transmission device of the above third embodiment according to the present invention.

Referring to FIGS. 13 and 14, a window apparatus with built in shading device according to a third preferred embodiment of the present invention is illustrated, which comprises a window framework 100", an outer transparent board 13*c* and an inner transparent board 13*d*. One side of each transparent board 13*c*, 13*d* is pivotedly mounted at a vertical side of the window framework 100". A shading device 20", as disclosed in the above first embodiment or a conventional blind, is installed within the window framework 100" and between the outer and inner transparent boards 13*c* and 13*d*. As shown in FIG. 12, a transmission device 40" is disposed on a horizontal side of the window framework 100" for enabling the two transparent boards 13*c*, 13*d* to swing in or out simultaneously, i.e. when one of the transparent boards 13*c*, 13*d* is swung in to close the window or swung out to open the window, the other transparent board 13*c*, 13*d* is transmitted to swing in or out simultaneously.

The transmission device 40" comprises two driving gears 41", 42" and two engaging driven gears 43", 44" rotatably mounted on one end of a bottom side of the window framework 100", in which the first driving gear 41" is affixed to an end corner of a bottom side of the transparent board 13*d* while the second driving gear 42" is affixed to an end corner of a bottom side of the transparent board 13*c*. Moreover, the first driving gear 41" is meshed with the first driven gear 43" which is meshed with the second driven gear 44". The second driving gear 42" is meshed with the second driven gear 44". Accordingly, when the user swings one of the transparent boards 13*d*, the first driving gear 41" will be driven to rotate. Then the second driving gear 42" is driven to rotate the same angle simultaneously through the transmission of the two driven gear 43", 44", so that the other transparent board 13*c* will be driven to swing with the same angle simultaneously. The aim of this third embodiment is to illustrate that the transparent boards of the window apparatus of the present invention are able to swing to open or close the window.

In accordance with the embodiments disclosed above, the present invention can achieve the following advantages:

(1) The window apparatus of the present invention has a built in shading device installed within dual sheets of glass, plastic, and etc., which can provide a more efficient way of shading and the blocking of light.

(2) The dual glasses configuration of the shading device of the window apparatus of the present invention can provide a more efficient way of insulating temperature and furthermore the present invention is more efficient to provide the resistance of sound entering and leaving the environment surroundings.

(3) The shading slats of the window apparatus of the present invention is isolated from the surroundings to installed between two window glasses so that the dust in the environment can be prevented from direct contact with the slats so as to maintain the clean and tidy of the slats for much longer period and a better appearances for aesthetic purposes. An easy way of cleaning the slats is by merely detaching one of the window glass as in the first embodiment or opening the window as in the second or third embodiments.

(4) The window apparatus with built in shading device of the present invention can be electrically operated.

(5) The window apparatus with built in shading device of the present invention is able to apply to the front and back wind shields or the side windows of an automobile, in which each slats can be made in arcuate shape for conforming the curvature of the front or back wind shield.

(6) Due to the innovation design of installing the shading device in the receiving chamber defined by the window framework and the pair of transparent boards of the present invention, as shown in FIGS. 6A and 6B, those slats of the shading device are able to be gathered within one of the first frames or the second frames. In other words, the gathered shading device can be entirely hidden in the window framework in order to provide a neat appearance. On the contrary, the conventional blind is merely hanged on the window, wherein such exposed blind is no way to hide.

I claim:

1. A window apparatus, comprising:

a window framework which comprises a first pair of parallel frames which are two symmetrical U-shaped vertical frames, a second pair of parallel frames which are two symmetrical U-shaped frames perpendicularly mounted between two top ends and two bottom ends of said first pair of parallel frames respectively to define a window framework, and a pair of transparent boards which are parallelly mounted on said framework to define a receiving chamber therebetween, wherein each said first pair of frames has two parallel walls and an end wall perpendicularly extended between two outer sides of said two parallel walls, two inner sides of said two parallel walls of each said first frame have two longitudinal first recesses provided respectively, wherein an operation chamber is defined between said two first recesses and said end wall, each of said second pair of frames having two parallel walls and en end wall perpendicularly extended between two outer sides of said parallel walls, two inner sides of said two parallel walls of each said second frame having two longitudinal second recesses provided thereon respectively, wherein a spacing chamber is defined between said two second recesses and said end wall, so that said four first recesses of said two first frames and said four second recesses of said two second frames form a first and a second periphery receiving recess to receive four edges of each of said transparent boards respectively for mounting said two transparent boards on said window framework, wherein said receiving chamber is a space formed between said two transparent boards;

a shading device which comprises a plurality of parallel slats and a supporting device for mounting said slats inside said receiving chamber, wherein said supporting device comprises a pair of supporting chains and a plurality of supporters connected to said ends of said slats respectively, each said supporting chains extending along said operation chambers of said two vertical first frames respectively, wherein said plurality of supporters are equally spaced and hanged by engaging with said pair of supporting chains respectively so as to parallelly support said plurality of slats within said receiving chamber; and a control device for adjusting said slats to a predetermined displacing angle, gathering said slats toward a side of said window framework, and distributing said slats over said receiving chamber.

2. A window apparatus, as recited in claim 1, wherein each of said supporters has a receiving mouth at one end for engaging with one end of said respective slat, a cylindrical guider protruded from a central portion of another end thereof, and two side shoulders extended from two sides thereof, and that a guiding rail is formed along a central portion of said end wall of each of said first frames, wherein said supporters are disposed inside said first pair of frames respectively with said two side shoulders extended within said operation chambers, and said guiders of said supporters are disposed in said two guiding rails respectively, so that each of said slats is capable of rotating along an axis between said two guiders of said two supporters engaged to said two ends of said respective slat and moving up and down while said respective slat is guided by said guiding rails of said first pair of frames, wherein each of said side shoulders is firmly engaged to a predetermined position of said respective supporting chain.

3. A window apparatus, as recited in claim 2, wherein said control device comprises a gathering, mechanism which comprises a driving rod rotatably mounted along said top second frame and two cord pulleys affixed to two end portions of said driving rod, wherein one end of said driving rod further comprises a driven wheel in close proximity to said cord pulleys, said gathering mechanism further comprising a pair of cords, an endless driving chain, a driving wheel, and a driving worm gear, said two cords having two first ends winding over said two cord pulleys and connecting with two balance loads respectively, wherein said two balance loads, which are disposed within said operation chambers of said two first frames, have a total weight equal to a total weight of all said slats and said supporters, a second end of each said cord being extended downward through a through hole provided on each of said supporters and being disposed within said operation chambers of said two first frames, wherein said second ends of said two cords are respectively affixed to a lowermost pair of said supporters, so that said plurality of slats are hanged and supported inside said receiving chamber.

4. A window apparatus, as recited in claim 3, wherein said driving wheel is rotatably mounted in said bottom second frame and said driving chain is linked between said driven wheel and said driving wheel by engaging with said driven wheel and said driving wheel, wherein said driving worm gear, which is meshed with a driving wheel worm gear coaxially mounted to said driving wheel, is transversely disposed inside said bottom second frame and has a shaft extending outside said bottom second frame.

5. A window apparatus, as recited in claim 4, wherein said shaft of said driving worm gear is secured with a rotation button.

6. A window apparatus, as recited in claim 2, wherein said control device comprises a tilting mechanism which comprises a tilt rod having two tilters mounted near two end portions thereof respectively, an endless driving thread winding over said first tilt wheel, and a second tilt wheel rotatably mounted on a supporting shaft, wherein said supporting shaft is rotatably mounted in said bottom second frame and has a driving gear rotatably mounted thereon, an operating worm gear being transversely disposed inside said bottom second frame, and an operating button connected to a shaft of said operating worm gear which is positioned outside said bottom second frame, wherein two top ends of said two supporting chains are winded around said two tilters respectively, so that when said tilting rod is rotated, said plurality of slats within said receiving chamber of said window framework are driven to tilt with a desired slant angle, and that said slant angle of each of said slats is able to adjust simultaneously by rotating said operating button.

7. A window apparatus, as recited in claim 5, wherein said control device comprises a tilting mechanism which comprises a tilt rod having two tilters mounted near two end portions thereof respectively, an endless driving thread winding over said first tilt wheel, and a second tilt wheel rotatably mounted on a supporting shaft, wherein said supporting shaft is rotatably mounted in said bottom second frame and has a driving gear rotatably mounted thereon, an operating worm gear being transversely disposed inside said bottom second frame, and an operating button connected to a shaft of said operating worm gear which is positioned outside said bottom second frame, wherein two top ends of said two supporting chains are winded around said two tilters respectively, so that when said tilting rod is rotated, said plurality of slats within said receiving chamber of said window framework are driven to tilt with a desired slant angle, and that said slant angle of each of said slats is able to adjust simultaneously by rotating said operating button.

8. A window apparatus, as recited in claim 2, wherein said two cords of said gathering mechanism are further firmly secured with said uppermost slat, said control device further comprising a tilting mechanism which comprises a tilt rod disposed inside said bottom second frame, said tilt rod further comprising two tilters mounted near two end portions thereof respectively and a tilt worm gear mounted at one end of said tilt rod, wherein an operating worm gear which is meshed with said tilt worm gear is transversely disposed inside said bottom second frame and an operating button is connected to a shaft of said operating worm gear which is positioned outside said bottom second frame, wherein two top ends of said two supporting chains are respectively affixed to said tow supporters connecting to said two ends of said uppermost slat respectively and two bottom ends of said two supporting chains are engaged with said two titlers respectively, so that when said tilting rod is rotated, said plurality of slats are driven to tilt with a desired slant angle, and that said slant angle of each of said slats is able to adjust simultaneously by rotating said operating button.

9. A window apparatus, as recited in claim 5, wherein said two cords of said gathering mechanism are further firmly secured with said uppermost slat, said control device further comprising a tilting mechanism which comprises a tilt rod disposed inside said bottom second frame, said tilt rod further comprising two tilters mounted near two end portions thereof respectively and a tilt worm gear mounted at one end of said tilt rod, wherein an operating worm gear which is meshed with said tilt worm gear is transversely disposed inside said bottom second frame and an operating button is connected to a shaft of said operating worm gear which is positioned outside said bottom second frame, wherein two top ends of said two supporting chains are respectively affixed to said tow supporters connecting to said two ends of said uppermost slat respectively and two bottom ends of said two supporting chains are engaged with said two titlers respectively, so that when said tilting rod is rotated, said plurality of slats are driven to tilt with a desired slant angle, and that said slant angle of each of said slats is able to adjust simultaneously by rotating said operating button.

10. A window apparatus, as recited in claim 1, furthering comprising at least an auxiliary supporting device disposed between and parallel to said pair of first frames, wherein said auxiliary supporting device includes a plurality of supporting seats and a pair of supporting chains attached to two sides of each of said supporting seats, wherein a middle portion of each of said slats is mounted on said corresponding supporting seat, and two ends of said two supporting chains are affixed to said top second frame for hanging and supporting said supporting seats.

11. A window apparatus, as recited in claim 7, furthering comprising at least an auxiliary supporting device disposed between and parallel to said pair of first frames, wherein said auxiliary supporting device includes a plurality of supporting seats and a pair of supporting chains attached to two sides of each of said supporting seats, wherein a middle portion of each of said slats is mounted on said corresponding supporting seat, and two ends of said two supporting chains are affixed to said top second frame for hanging and supporting said supporting seats.

12. A window apparatus, as recited in claim 9, furthering comprising at least an auxiliary supporting device disposed between and parallel to said pair of first frames, wherein said auxiliary supporting device includes a plurality of supporting seats and a pair of supporting chains attached to two sides of each of said supporting seats, wherein a middle portion of each of said slats is mounted on said corresponding supporting seat, and two ends of said two supporting chains are affixed to said top second frame for hanging and supporting said supporting seats.

13. A window apparatus, as recited in claim 1, further comprising an electrical driving device equipped with said control device for electrically operating said shading device.

14. A window apparatus, as recited in claim 11, further comprising an electrical driving device which comprises two rotary power sources, two driving shafts and two deceleration gear boxes for decelerating a rotating speed of said two driving shafts respectively, wherein said two driving shafts are connected to said second tilt wheel and said driving wheel respectively and are driven by said two rotary power sources respectively.

15. A window apparatus, as recited in claim 12, further comprising an electrical driving device which comprises two rotary power sources, two driving shafts and two deceleration gear boxes for decelerating a rotating speed of said two driving shafts respectively, wherein said two driving shafts are connected to said second tilt wheel and said driving wheel respectively and are driven by said two rotary power sources respectively.

16. A window apparatus, comprising:

a window framework which comprises a first pair of parallel frames and a second pair of parallel frames which are perpendicularly mounted between said first pair of parallel frames to define a window framework, wherein each of said first frames of said window framework is positioned horizontally and has two inner sliding grooves for slidably receiving a first pair of transparent boards and two outer sliding grooves for slidably receiving a second pair of transparent boards, so that said first and second transparent boards are able to slide from left to right or from right to left, wherein said window framework further comprises a first connector connecting said first pair of transparent boards together at their bottom corner positions near one of said second frames, which are positioned vertically, and a second connector connecting said second pair of transparent boards together at their bottom corner positions near said other second frame, so that a receiving chamber is defined between said first and second transparent boards;

a shading device which comprises a plurality of parallel slats and a supporting device for mounting said slats inside said receiving chamber; and a control device for adjusting said slats to a predetermined displacing angle, gathering said slats toward a side of said window framework, and distributing said slats over said receiving chamber.

17. A window apparatus, comprising:

a window framework which comprises a first pair of parallel frames, a second pair of parallel frames which are perpendicularly mounted between said first pair of parallel frames to define a window framework, a pair of transparent boards which are parallelly mounted on said framework to define a receiving chamber therebetween, wherein one side of each said transparent board is pivotally mounted at one of said two second frames which are positioned vertically;

a shading device which comprises a plurality of parallel slats and a supporting device for mounting said slats inside said receiving chamber;

a control device for adjusting said slats to a predetermined displacing angle, gathering said slats toward a side of said window framework, and distributing said slats over said receiving chamber; and a transmission device, which is disposed on one of said two first frames which are positioned horizontally, adapted for enabling said two transparent boards to swing simultaneously, wherein when one of said transparent boards is swung, said another transparent board is driven to swing by said transmission device simultaneously.

18. A window apparatus, as recited in claim 17, wherein said transmission device comprises two driving gears and two engaging driven gears rotatably mounted on one end of a bottom side of said window framework, wherein said first driving gear is affixed to an end corner of one of said transparent boards while said second driving gear is affixed to an end corner of said another transparent board, wherein said first driving gear is meshed with said first driven gear which is meshed with said second driven gear, and said second driving gear is meshed with said second driven gear.

* * * * *